United States Patent [19]

Apfel et al.

[11] Patent Number: 4,693,007

[45] Date of Patent: Sep. 15, 1987

[54] GUIDE BAR FOR A CHAIN SAW

[75] Inventors: Norbert Apfel; Hans-Peter Stehle; Wilfried Noll, all of Waiblingen, Fed. Rep. of Germany

[73] Assignee: Andreas Stihl, Waiblingen, Fed. Rep. of Germany

[21] Appl. No.: 860,122

[22] Filed: May 6, 1986

[30] Foreign Application Priority Data

May 25, 1985 [DE] Fed. Rep. of Germany ..... 3518990

[51] Int. Cl.[4] ..... B27B 17/02

[52] U.S. Cl. ..... 30/387; 30/383

[58] Field of Search ..... 30/381, 383, 387

[56] References Cited

U.S. PATENT DOCUMENTS 2,165,524 7/1939 Wolf ..... 30/387
2,660,204 11/1953 Rosenboom ..... 30/387
3,191,646 6/1965 Merz ..... 30/387
4,138,813 2/1979 Harada et al. ..... 30/387
4,486,953 12/1984 Halverson ..... 30/387 X

*Primary Examiner*—E. R. Kazenske
*Assistant Examiner*—Michael D. Folkerts
*Attorney, Agent, or Firm*—Walter Ottesen

[57] ABSTRACT

A guide bar for a chain saw includes three layers. The two outer layers are defined by side plates which can be welded together by means of inserts and the intermediate member located therebetween is held in a form-tight manner by means of the inserts that are welded to the side plates. Because of this configuration, the intermediate member may be made of plastic or aluminum thereby reducing the weight of the chain saw. The guide bar with this sandwich configuration has excellent strength and has a weight less than conventional guide bars of comparable size.

17 Claims, 12 Drawing Figures

GUIDE BAR FOR A CHAIN SAW

FIELD OF THE INVENTION

The invention relates to a guide bar for a chain saw having two side parts welded together, with at least one intermediate part firmly joined to the former and sandwiched therebetween. The side parts extend beyond the intermediate part to define a guide groove for the saw chain.

BACKGROUND OF THE INVENTION

Guide bars of this type are provided in power-driven chain saws for guiding and supporting an endless saw chain revolving about the guide bar.

Chain saws of this type intended for portable use are guided and carried by hand when in operation. For this reason, attempts have been made for a long time to reduce the weight of such chain saws as much as possible. Attempts have also been made to reduce the weight of the guide bar, since the guide bar, which for reasons of strength is usually made of steel, contributes considerably to the overall weight of the tool.

In a known chain saw, the guide bar has been designed in a sandwich form for this reason and includes two side parts and an intermediate part disposed therebetween and tightly joined thereto. The side parts extend beyond the intermediate part to form a guide groove for the saw chain. The side parts and intermediate part are made of steel and are joined to each other by spot welds. To reduce the weight, cutouts are provided in the intermediate part, so that the intermediate part substantially comprises a narrow ring which forms the base of the groove. The two sides of the ring are joined by strut-like webs. The function of this intermediate part having the cutouts is to assure accurate spacing between the two side parts, to determine the depth of the groove, and to prevent chips or the like from getting in between the side parts.

This known guide bar has the disadvantage that it is still relatively heavy, especially when the guide bars are long.

SUMMARY OF THE INVENTION

It is an object of the invention to provide a guide bar of the type described above wherein the weight of the guide bar is reduced. It is a further object of the invention to provide a guide bar wherein the intermediate part is made of a material having a low specific weight that is not weldable to the side parts and still enables the guide bar to match known guide bars in terms of its strength.

The guide bar of the invention attains this object in that only the two side parts are welded together, and the intermediate part is made of a material having a specific weight lower than that of the side parts and is held in place therebetween by form-fitting elements.

Because the side parts are advantageously welded together but the intermediate part is not welded thereto and, after welding, is form-tightly disposed therebetween, it is also possible to make the intermediate part of materials that cannot be welded to the side parts without thereby reducing the strength of the guide bar as compared with known guide bars. By suitably selecting a material having a low specific weight for the intermediate part, a considerable reduction in the overall weight of the guide bar can be achieved.

BRIEF DESCRIPTION OF THE DRAWING

The invention will now be described with reference to the drawing wherein.

DESCRIPTION OF THE PREFERRED EMBODIMENTS OF THE INVENTION

Figure 1:
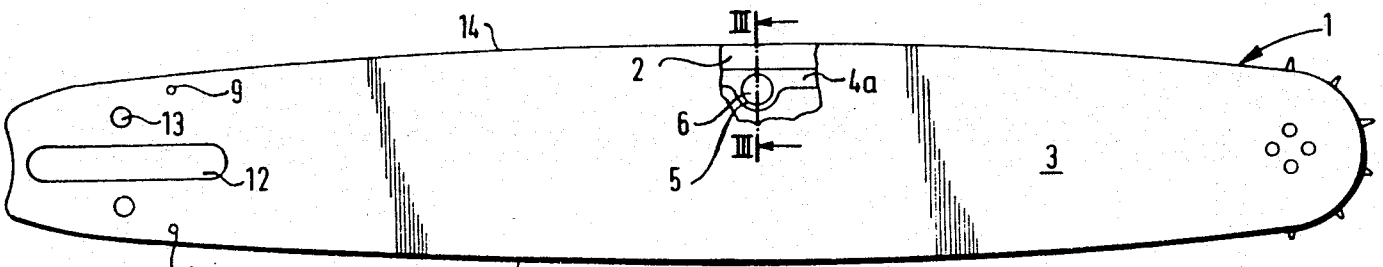
FIG. 1 is a side elevation view of a guide bar according to the invention with a portion of a side plate broken out to show the intermediate part.
Figure 2:
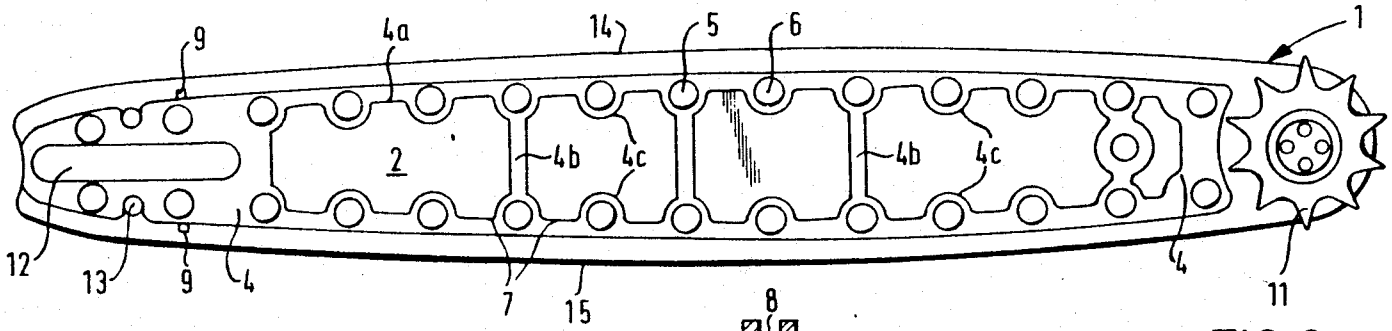
FIG. 2 is a side view similar to FIG. 1 but with one of the side plates removed.
Figure 3:
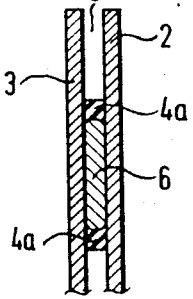
FIG. 3 is a section view, on a larger scale, taken along the line III—III of FIG. 1.

The guide bar 1 for a chain saw shown in FIGS. 1 to 3 is made in sandwich fashion and substantially comprises three layers, that is, the two outer side parts 2 and 3 and the intermediate part 4 disposed therebetween which, in this embodiment, is joined in a form-tight manner to the side parts 2, 3 by means of steel inserts 6. The side parts 2 and 3 extend beyond the intermediate part on the top, front and bottom, so that a guide groove 8 for the saw chain is formed. The base of the groove is formed on the top 14 and bottom 15 of the guide bar 1 by the intermediate part 4. On the end whereat the guide bar 1 is secured (on the left as seen in FIGS. 1 and 2) to the motor housing of a chain saw (not shown), the intermediate part 4 ends where the side parts 2 and 3 end; toward the free end of the guide bar 1 (on the right in FIGS. 1 and 2), the intermediate part 4 extends to shortly before an idler pinion 11, which is supported so as to be freely rotatable between the front ends of the side parts 2, 3.

For securing the guide bar 1 inside the motor housing of the chain saw (not shown), an elongated slot 12 as well as respective bores 13 located above and below the slot are provided in a known manner. The slot extends in alignment through the side parts 2, 3 and the intermediate part 4.

As shown in FIG. 2, the intermediate part 4 in this embodiment includes a surrounding rim **4*a* and webs 4*b* extending from the upper to the lower rim 4*a*. The surrounding rim 4*a* is relatively narrow and has inwardly pointing protrusions 5, which are advantageously circular as shown for this embodiment but may also have any other desired geometric shape. Like the side parts 2, 3, the intermediate part 4 is fabricated from sheet metal, preferably as a stamped part, and the cutouts 7 that are clearly visible in FIG. 2 are stamped out of the intermediate part 4 to reduce its weight, so that the intermediate part 4 is defined substantially by the narrow surrounding rim 4*a* with its protrusions 4*c* and the webs 4*b***.

In the rear portion of the guide bar 1 (on the left in FIGS. 1 and 2), oil bores 9 are provided in the side parts 2, 3, respectively, near the top 14 and bottom 15. These bores 9 extend in mutual alignment in the side parts 2 and 3 and are advantageously arranged such that they are tangent to the outer periphery of the intermediate part 4 as shown in FIGS. 1 and 2. The oil bores 9 can be provided precisely at the level of the base of the groove in this case, and the lower parts of the driving members of the saw chain carry along virtually all the oil that flows into the groove via the oil bores 9 as they are moved through the groove. This arrangement of the oil bores 9 provides better lubrication of the saw chain as compared with known embodiments.

Figure 7A:
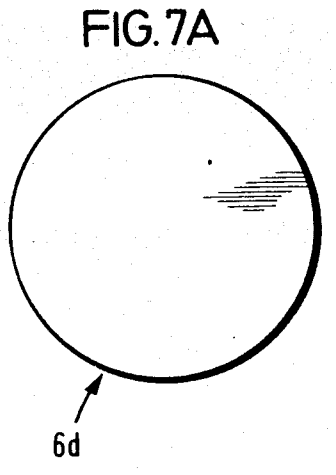
FIGS. 4A, 5A, 6A and 7A are plan views of respective steel inserts which can be used to secure the intermediate part in the guide bar of the invention.
Figure 7B:
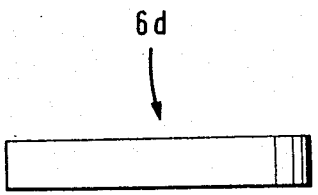
FIGS. 4B, 5B, 6B and 7B are side elevation views of the steel inserts shown in FIGS. 4A to 7A, respectively; and, FIG. 8 shows another embodiment of the invention wherein mutually adjacent and inwardly directed raised portions of the side plates define projections which, when welded, conjointly define projection welds for joining the side plates to each other.

The two side parts 2 and 3, which in this embodiment are made of steel, are welded together via steel inserts 6, which are located in recesses 5 of the intermediate part 4. A steel insert 6 of this type is shown in FIGS. 7A and 7B. These wafer-like steel inserts 6 are preferably round and have the shape of a recess 5 in the intermediate part 4. Other arbitrary geometric shapes are also conceivable, such as steel inserts that are triangular in plan view and located in round recesses, and so forth; the only important factor is the positive engagement between the steel insert and the intermediate part 4.

The circular steel inserts 6 shown here, located in the correspondingly round recesses 5, have proved to be particularly favorable. If the side parts 2 and 3 are joined with the steel inserts 6 by spot welding, the steel inserts 6 have the same thickness as the intermediate part 4. For welding, the intermediate part 4, equipped with the steel inserts 6, is placed between the side parts 2 and 3 and positioned; then from the outer sides of the side parts 2 and 3, welding electrodes are applied to the points where the steel inserts are located. The top and bottom of the steel inserts form contact surfaces, through which the electric current flows from one side plate 2 to the other side plate 3, thereby effecting spot welding between the side part 2, the steel inserts 6 and the side part 3.

The welding points are preferably spaced axially apart at intervals of 3 cm and are distributed evenly over the entire length of the guide bar on the top 14 and bottom 15. The recesses 5 in the intermediate part 4 should be arranged such that the welding points are located as near as possible to the top 14 or bottom 15, because this increases the strength of the guide bar 1 and prevents possible shifting. A certain minimum spacing from the base of the groove, that is, from the outer circumference of the intermediate part 4, is necessary under all circumstances, however, to prevent the spot welding from deforming the groove base. In the embodiment shown here, this minimum spacing amounts to approximately 4 mm, with a diameter of 6 to 10 mm for the steel inserts and a diameter of the spot welds of approximately 5 mm.

Figure 6A:
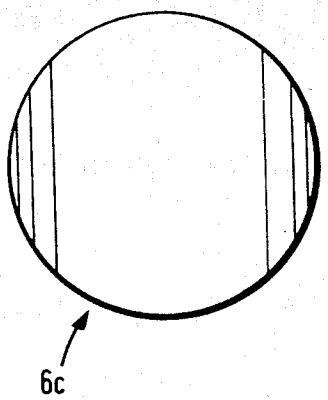
Figure 6B:
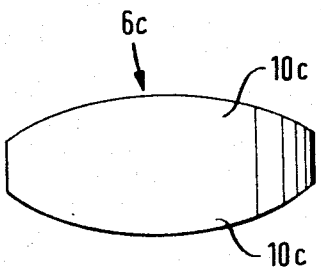
Figure 5A:
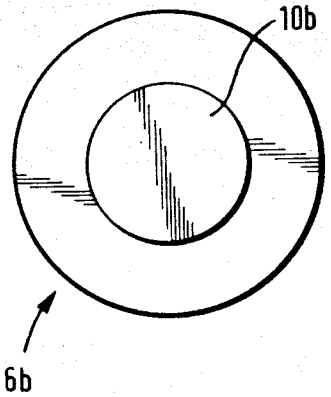
Figure 5B:
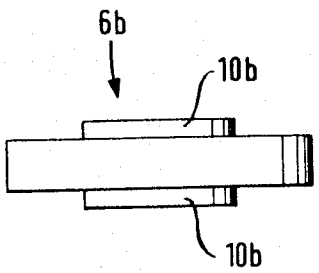
Figure 4A:
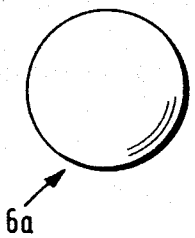
Figure 4B:
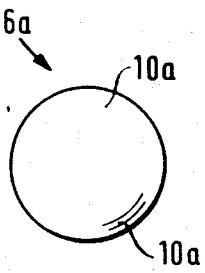

FIGS. 4 to 6 show further embodiments of the steel inserts 6, which are provided for joining the side parts 2 and 3 by projection welding. The side parts 2, 3 and intermediate part 4 are configured in the manner shown for the embodiment according to FIGS. 1 to 3; however, the steel inserts 6 differ in shape. The projections required for projection welding are shown at 10*a*, 10*b* and 10*c* in FIGS. 4 to 6, respectively; before welding, these projections protrude outwardly beyond the intermediate part 4. During welding, the raised projections (10*a*, 10*b*, 10*c*) form the contact bridges with the side parts 2 and 3 and, on being welded, these projections merge with the overall body of the steel inserts, so that here again the spacing between the side parts 2 and 3 is determined by the thickness of the intermediate part 4. FIGS. 4A and 4B show a spherical steel insert 6; FIGS. 5A and 5B show a steel insert that is basically cylindrical and has cylindrical projections 10*b* on its top and bottom; and, FIGS. 6A and 6B show a steel insert again with a basically cylindrical body but with lenticular projections 10*c* on the top and bottom. In selecting the dimensions of the steel inserts 6 for projection welding, care must be taken that the overall volume of the steel insert 6 be no greater than the internal volume of a recess 5, so that the spacing between the side parts 2 and 3 will be determined only by the thickness of the intermediate part 4.

The shapes of the steel inserts 6 shown here are particularly favorable, but here again, the shapes of the recess 5 and the associated steel inserts are variable within wide limits.

The projections required for projection welding can also be provided in the side parts 2, 3, for example, by pressing them in beforehand. The steel inserts 5 used here can then be embodied like the steel inserts required for spot welding.

Within the scope of the invention, balls of appropriate dimension can be used as steel inserts, in which case no recesses 5 are provided in the intermediate part 4; instead, the recesses are made later by pressing the balls 6*a* into the intermediate part. Advantageously, the balls 6*a* should be pressed into the intermediate part 4 such that spherical portions protrude from both sides of the intermediate part 4 thereby forming the projections 10*a* required for projection welding.

The form-tight elements, which are steel inserts 6 in the emobidments described above can, like the side parts (2, 3), also be made from materials other than steel. The essential factor here is that the parts can be weldable to one another, in particular, by a resistance pressure welding method. In the selection of the material for the intermediate part 4, aluminum, lightweight metal alloys and plastics have proved to be advantageous; the essential prerequisites are a low specific weight, certain strength properties and good thermal resistance. Especially when plastics are used, care must be taken that the heat introduced into the workpiece by the welding process does not cause any permanent deformation of the intermediate part 4; correspondingly, the material must also be able to withstand the heat produced during operation when the chain saw is under a heavy load.

The strength of the spot welds between the steel inserts 6 and the side parts 2 and 3 in the embodiments described above corresponds to the strength of conventional guide bars wherein the intermediate part is made of steel.

If the intermediate part 4 is made of aluminum or plastic, as in the embodiment described above, then the tolerance of the depth of the groove can be closer, because when a driving member of the saw chain moves on the base of the groove, the result is no longer the undesirable friction of steel on steel, which either damages the base of the groove or causes unintended lifting of the chain members. The closer tolerance of the groove depth is particularly advantageous because the oil bore 9 provided in the region where the guide bar is attached to the motor housing can now be provided precisely at the level of the base of the groove, so that the lower portion of the driving member can carry along with it virtually all the oil flowing in via the oil bore 9. In this way, better lubrication of the saw chain is achieved, which reduces wear; also, the amount of lubricating oil used can be reduced because it is distributed better.

Figure 8:
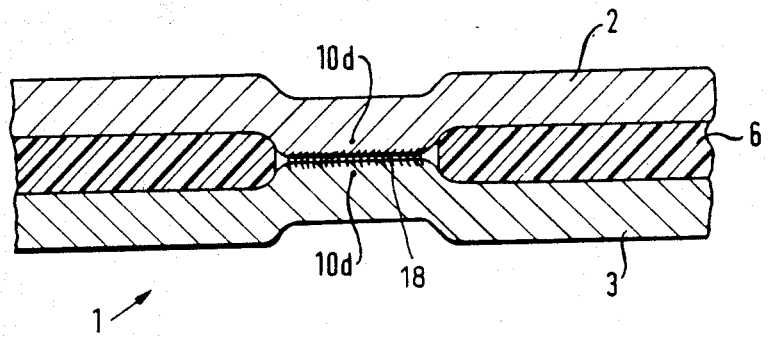

In the embodiment of the guide bar of FIG. 8, the side plates 2 and 3 are provided with respective projections 10*d* which extend into an aperture formed in the intermediate part 6. The projections 10*d* conjointly define an interface whereat the two projections are joined together by weld 18.

The embodiments of guide bars shown in the drawings and described above are relatively simple, and hence inexpensive, to manufacture and, in comparison with conventional guide bars, they have a markedly reduced weight, with the same strength.

It is understood that the foregoing description is that of the preferred embodiments of the invention and that various changes and modifications may be made thereto without departing from the spirit and scope of the invention as defined in the appended claims.

What is claimed is:

1. A guide bar for guiding the saw chain of a chain saw comprising:

two flat side members;

an intermediate member sandwiched between said side members;

said side members extending laterally beyond the outer periphery of said intermediate member for conjointly defining a guide groove therewith for guiding the saw chain in its movement around the guide bar;

said intermdeidate member being made of a material non-weldable to said side members and having a specific weight less than the specific weight of the material of which said side members are made;

form-fitting holding means for holding said intermediate member firmly in position between said side members, said form-fitting holding means including a plurality of apertures formed in said intermediate member; and, a plurality of form-fitting elements seated in corresponding ones of said apertures and made of a material weldable to said side members;

said flat side members being made of a solid material devoid of apertures in the regions thereof adjacent respective ones of said elements;

a first plurality of welds for welding corresponding ones of said elements to one of said two flat side members; and, a second plurality of welds for welding corresponding ones of said elements to the other one of said two flat side members.

2. The guide bar of claim 1, said plurality of form-fitting elements being configured to extend through corresponding ones of said apertures.

3. The guide bar of claim 2, said two flat side members being made of sheet steel; and, said form-fitting elements being steel inserts disposed in corresponding ones of said apertures.

4. The guide bar of claim 3, said apertures being arranged in the vicinity of the outer periphery of said intermediate member and being distributed with approximately equal spacing one from the other.

5. The guide bar of claim 4, said intermediate member being a frame-like structure with inwardly-directed projections for accommodating corresponding ones of said apertures.

6. The guide bar of claim 1, said intermediate member being made of light metal.

7. The guide bar of claim 1, said intermediate member being made of plastic.

8. The guide bar of claim 1, said intermediate member being made of a light-metal alloy.

9. The guide bar of claim 1, said apertures being respective bores and said elements each having a circular cross-section to correspond to the form of said bores.

10. The guide bar of claim 1, said welds being spot welds and said elements having the same thickness as said intermediate member.

11. The guide bar of claim 2, said first plurality of welds being a first plurality of projection welds connecting corresponding ones of said elements to said one of said flat members and said second plurality of welds being a second plurality of projection welds connecting corresponding ones of said elements to said other one of said flat members.

12. The guide bar of claim 11, said elements each having two projections projecting outwardly beyond the thickness of said intermediate member before said welds are formed.

13. The guide bar of claim 12, said plurality of form-fitting elements being a plurality of spheres, said projections being spherical zones projecting outwardly beyond said intermediate member.

14. The guide bar of claim 12, said projections having a lenticular configuration.

15. The guide bar of claim 12, said projections having a cylindrical configuration with respective end faces facing corresponding ones of said flat side members.

16. The guide bar of claim 1, said two flat side members each being adapted at one end for mounting the guide bar to the motor housing of the chain saw, the flat side members including lubricating oil bore means formed therein at an elevation corresponding to the outer periphery of said intermediate member, said oil bore means extending to the base of said guide groove for conducting the lubricating oil thereto.

17. The guide bar of claim 1, said form-fitting elements being a plurality of spheres pressed into said intermediate member for forming said plurality of apertures therein.

* * * * *